US006877299B2

(12) United States Patent
Dubourg

(10) Patent No.: US 6,877,299 B2
(45) Date of Patent: Apr. 12, 2005

(54) HAND GRIP FOR ASSISTING A BEGINNER RIDER IN REIN CONTROL

(76) Inventor: Yann Dubourg, Chateau Perron, Roaillan (FR), F-33210

( * ) Notice: Subject to any disclaimer, the term of this patent is extended or adjusted under 35 U.S.C. 154(b) by 0 days.

(21) Appl. No.: 10/450,378

(22) PCT Filed: Dec. 12, 2001

(86) PCT No.: PCT/FR01/03968

§ 371 (c)(1),
(2), (4) Date: Jun. 13, 2003

(87) PCT Pub. No.: WO02/48021

PCT Pub. Date: Jun. 20, 2002

(65) Prior Publication Data

US 2004/0040267 A1 Mar. 4, 2004

(30) Foreign Application Priority Data

Dec. 13, 2000 (FR) ..... 00 16198

(51) Int. Cl.[7] ..... B68B 1/04
(52) U.S. Cl. ..... 54/36
(58) Field of Search ..... 54/3, 25, 36, 43.1, 54/57, 74, 77, 85; 119/770, 857; 473/205

(56) References Cited

U.S. PATENT DOCUMENTS 229,405 A * 6/1880 Hartman ..... 54/15
501,308 A * 7/1893 Whiting ..... 54/74
818,792 A * 4/1906 Schmeiser ..... 54/16
1,412,322 A * 4/1922 Thompson ..... 54/32
1,509,704 A * 9/1924 Bowlen ..... 54/32
2,450,719 A * 10/1948 Davis ..... 54/18.2
4,495,753 A * 1/1985 Simpson ..... 54/24
4,716,715 A * 1/1988 Johnson ..... 54/44.5
5,076,041 A * 12/1991 Proust ..... 54/2
5,148,656 A * 9/1992 Meaghan ..... 54/36
5,435,272 A * 7/1995 Epstein ..... 119/770
5,442,900 A * 8/1995 Ciampi ..... 54/71
6,085,500 A * 7/2000 Keppick ..... 54/71
6,145,478 A * 11/2000 Boyd et al. ..... 119/725
6,591,590 B1 * 7/2003 Henneberg ..... 54/36

FOREIGN PATENT DOCUMENTS

DE 29 09 113 9/1980

* cited by examiner

*Primary Examiner*—Teri Pham Luu
*Assistant Examiner*—Bret Hayes
(74) *Attorney, Agent, or Firm*—Young & Thompson

(57) ABSTRACT

A device, designed to be used in horse riding, includes hand grips linked to a collar enclosing a horse's neck. The hand grips are compact and do not hinder the use of reins, the element linking the hand grip to the collar partly consists of an elastic and the collar is fixed midway on the neck so as to allow the hands translational and lateral freedom. The device enables to avoid faulty handling on the experienced rider's part, enables the beginner to find the right balance and controls the horse's mouth.

18 Claims, 1 Drawing Sheet

HAND GRIP FOR ASSISTING A BEGINNER RIDER IN REIN CONTROL

BACKGROUND OF THE INVENTION

The present invention relates to a device, adapted to be used in horseback riding, comprising handgrips connected to a collar passing about the neck of a horse, characterized in that the handgrips are of reduced size and do not impede the use of the reins, that the attachment between the handgrip and the collar is partially comprised by elastic, and that the securement to the collar takes place at mid-neck so as to permit the independence of the hand both in translation and laterally.

The device permits avoiding clumsiness of the hands of the experienced rider, assists the beginning rider in his riding lessons, and protects the mouth of the horse.

The present invention relates to a device seeking to facilitate the practice of horseback riding by acting on the securement and independence of the hands.

The independence of the aids (the seat, the legs, the hands) is an essential part of horseback riding. The use of a saddle seeks to facilitate the mastery of the seat, the stirrups facilitating the mastery and hence the independence of the legs.

Conventionally, to assist the control of his hands, the rider has two methods: to grasp the mane of the horse, or to grasp a collar passed about the horse's neck. These two empirical methods are contradictory: they improve the securement but prevent the necessary independence to direct the horse.

SUMMARY OF THE INVENTION

The device which is the object of the invention is a handgrip of a length equivalent to the width of three fingers (ring finger, middle finger, index finger) connected to a collar passed about the neck of the horse. This handgrip has the necessary rigidity to support a substantial pressure (as a function of the force and weight of the rider) and the slenderness necessary so as not to impede the use of the reins. The fingers enclose this handgrip and the reins. The handgrip is in direct contact with the fingers at the level of the third phalange, the reins are superposed on the handgrip by passing as taught in riding school, between the ring finger and the little finger and the index finger and the thumb. The handgrip is fixed to the collar thanks to a first fixed attachment on the handgrip between the ring finger and the middle finger. This securement permits the use of the handgrip without impeding the use of the reins. This first attachment is connected to an elastic which is itself connected to the collar via a second adjustable attachment fixed on the collar at mid-neck. The elastic permits an action in translation. The securement at mid-neck and the length of the straps and the elastic permit a lateral action of the hand. This mid-neck securement can be adjustable so as to adapt to the size of the horse and the rider. A system of two clips is fixed on the collar several centimeters below the level of the withers to permit the rider to fix the handgrips. These clips hold the handgrips in such a position as to permit the rider to grasp the handgrips rapidly with a simple movement. A snap clasp system with rapid attachment is stitched on the collar about three centimeters below the securement clips. This snap clasp permits rapidly and directly securing the attachment of the handgrip to the collar. By using this securement means, the rider can use the handgrips secured to the collar. The handgrips can comprise distinguishing means corresponding to the pennants near the obstacles: red for the right handgrip, white for the left handgrip. The collar is adjustable and can be fixed to the straps and to the saddle to ensure its support.

DETAILED DESCRIPTION OF THE PREFERRED EMBODIMENTS

Figure 1:
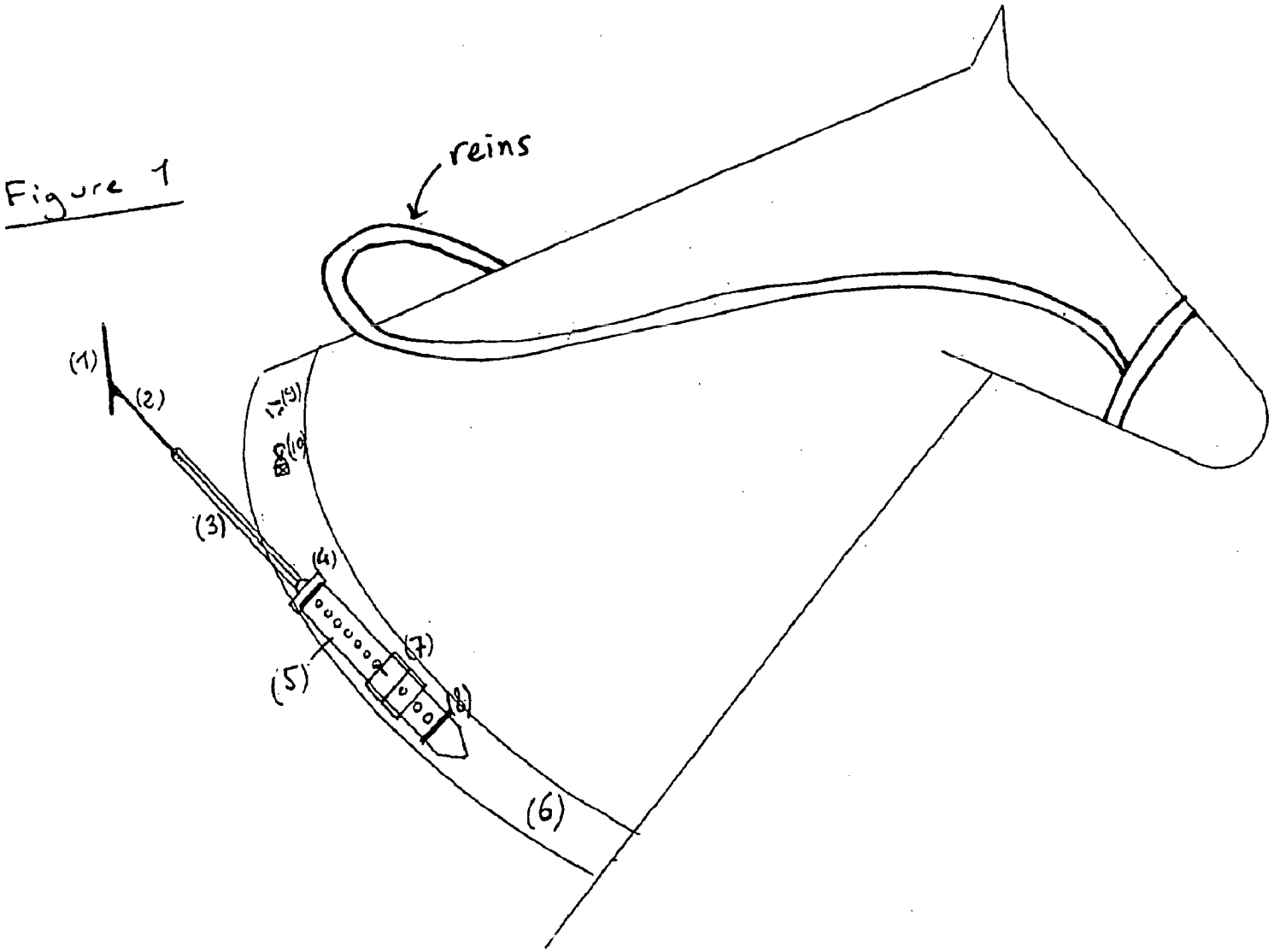
FIG. 1 is a schematic view of a handgrip of the present invention.

Referring to FIG. 1, the handgrip (1) can have a length equivalent to the width of three fingers.

The handgrip (1) can have a length equivalent to the width of three fingers.

The handgrip (1) can be made of steel and covered with a piece of leather.

The attachment of the handgrip (2) can, thanks to a system of stitching, be the prolongation of the leather piece having served to cover the handgrip (1).

This attachment (2) can have a length of 3 cm.

A ring can be stitched at the end of the attachment of the handgrip.

The elastic (3) can be fixed to the ring of the handgrip with the help of a snap clasp.

The elastic (3) can have a length of 6 cm.

The elastic (3) can be provided at its other end with an eyelet (4) which permits passing the securement strap to the collar (6).

The attachment between the elastic and the collar (6) can be a leather strap (5) of 40 cm stitched to the collar about 20 cm below the level of the withers, adjustable thanks to the eyelet of the elastic (4) through which it passes and a conventional buckle (7) stitched on the collar.

Loops (8) can be provided on the collar so as to receive the extra length of the adjustment leather strap (5).

Two clip securement supports (9) for the handgrips can be stitched on the collar 15 cm above the securement of the securement strap.

Snap clasps (10) with rapid attachment can be stitched on the collar about 3 cm below the clip securement supports (9).

The reduced size of the handgrip is such that it permits the use of the reins without particular impairment. The resistance of this handgrip and of the connection to the collar permits the rider to use this handgrip to maintain his position and to keep the hands in place under all circumstances. The use of an elastic permits the rider to have an action on the mouth of his horse, which action is voluntarily limited thanks to the resistance of the elastic.

According to an unillustrated modification, the handgrips can be fixed to a breast harness instead of and in place of the collar.

By way of non-limiting example, the handgrip will have a length of 4 cm, a width of 1 cm and a thickness of 0.5 cm. The leather strap connected to the handgrip will have a length of 3 cm, the elastic length of 6 cm and the leather strap connected to the collar a length varying from 2 to 20 cm according to the adjustment.

All equitation practices are subject to benefit from this invention.

A long adjustment of the device permits assisting the rider in seated position, whether he is a beginning or an experienced rider.

A short adjustment permits assisting a rider in the so-called suspension position, more particularly during jumping practice.

The use of the handgrips fixed on rapid attachments of the collar permits a rider rapidly to obtain a use of the handgrips near the use of a conventional collar with the comfort provided by the handgrip.

The device permits avoiding manual mistakes of the experienced rider, assists the beginning rider in training and protects the mouth of the horse.

What is claimed is:

1. A device to assist a rider in training, said device comprising:

two handgrips connected by straps and elastics to a collar passed about a neck of a horse; and a slender attachment that is passable between fingers of the rider and is fixed on a respective one of each of the handgrips, wherein the rider's use of reins is not impeded including when the reins are superposed on the device, so that the rider maintains their position on the horse.

2. The device according to claim 1, wherein each of the handgrips is dimensioned to have:

a length substantially equivalent to a width of three fingers: an index finger, a middle finger, a ring finger, a width of about one centimeter, and a thickness less than said width of the handgrips.

3. The device according to claim 1, wherein the attachment is connected to the elastics.

4. The device according to claim 3, wherein a length of securement between the elastics and the collar is adjustable by way of an eyelet fixed on the elastic and a buckle fixed on the collar.

5. The device according to claim 1, further comprising two adjustable attachments fixed to the collar at each side of a neck of a horse at a level located about mid-neck.

6. The device according to claim 5, wherein the adjustable attachments are adjustable over a length of about twenty centimeters.

7. The device according to claim 1, further comprising a system of clips fixed on the collar to allow the handgrips to be secured to the collar and allow rapid grasping of the handgrips on the collar.

8. The device according to claim 7, further comprising snap clasps having rapid attachments are stitched on the collar about three centimeters below the clips.

9. The device according to claim 1, wherein the handgrips comprise distinguishing means corresponding to pennants associated with obstacles comprising red for a right-hand one of said handgrips and white for a left-hand one of said handgrips.

10. The device according to claim 1, wherein the handgrips have a length of approximately 4 cm, a width of approximately 1 cm and a thickness of approximately 0.5 cm.

11. A device to be used in horseback riding to assist a rider in training, so as not to impede a rider using reins superposed on the device, said device comprising:

a collar that is tightened around a neck of a horse;

a pair of elastic elements connected to said collar on a respective side of said collar;

a pair of handgrips connected to a respective one of said elastic elements; and an elongate attachment member connected between a respective one of said elastic members and a respective one of the handgrips, wherein the rider's use of reins is not impeded including when the reins are superposed on the device.

12. The device according to claim 11, further comprising two adjustable attachment members fixed to the collar at each side of a neck of a horse at a level located about mid-neck.

13. The device according to claim 12, wherein a length of securement between a respective one of said elastic members and the collar is adjustable by way of an eyelet fixed on the respective elastic member and a buckle fixed on the collar.

14. The device according to claim 11, further comprising a system of clips fixed on the collar to allow the handgrips to be secured to the collar and allow rapid grasping of the handgrips on the collar.

15. The device according to claim 14, further comprising snap clasps having rapid attachments are stitched on the collar about three centimeters below the clips.

16. A device to be used in horseback riding to assist a rider in training so as not to impede a rider using reins superposed on the device in the rider's hands, said device comprising:

a pair of elastic elements connected to a collar that is tightened around a neck of a horse, on a respective side of said collar;

a pair of handgrips connected to a respective one of said elastic elements;

an elongate attachment member connected between a respective one of said elastic members and a first end of a respective one of said handgrips; and at least one clip fixed on said collar to allow said first end of said handgrips to be removably secured to said collar, wherein the rider's use of reins is not impeded including when the reins are superposed on the device.

17. The device as claimed in claim 16, wherein the handgrips have a length of 4 cm, a width of 1 cm and a thickness of 0.5 cm.

18. The device as claimed in claim 16, further comprising a leather strap stitched to the collar, said strap having a length that is variable from 2 to 20 cm, a respective one of said elastic members being connected to said strap.

* * * * *